US012601503B2

(12) United States Patent
Bernauer et al.

(10) Patent No.: US 12,601,503 B2
(45) Date of Patent: Apr. 14, 2026

(54) DOOR AND DOMESTIC COOKING DEVICE

(71) Applicant: BSH Hausgeräte GmbH, Munich (DE)

(72) Inventors: Maximilian Bernauer, Kienberg (DE); Frederic Dubois, Trostberg (DE); Wolfgang Hörner, Traunstein (DE); Peter Jell, Breitbrunn (DE); David Marechal, Grabenstätt (DE); Jakob Mayer, Kirchanschöring (DE); Christine Thaller, Waging (DE)

(73) Assignee: BSH Hausgeräte GmbH, Munich (DE)

( * ) Notice: Subject to any disclaimer, the term of this patent is extended or adjusted under 35 U.S.C. 154(b) by 590 days.

(21) Appl. No.: 18/008,688

(22) PCT Filed: Jul. 7, 2021

(86) PCT No.: PCT/EP2021/068847
§ 371 (c)(1),
(2) Date: Dec. 7, 2022

(87) PCT Pub. No.: WO2022/017798
PCT Pub. Date: Jan. 27, 2022

(65) Prior Publication Data

US 2023/0213208 A1 Jul. 6, 2023

(30) Foreign Application Priority Data

Jul. 22, 2020 (DE) ..... 102020209240.0

(51) Int. Cl.
*F24C 15/04* (2006.01)
*F24C 15/02* (2006.01)

(52) U.S. Cl.
CPC ..... *F24C 15/045* (2013.01); *F24C 15/021* (2013.01)

(58) Field of Classification Search
CPC ..... F24C 15/045; F24C 15/021
(Continued)

(56) References Cited

U.S. PATENT DOCUMENTS 1,654,426 A * 12/1927 Marshall ..... E05D 3/02 16/390
2,712,486 A * 7/1955 Kleinsorge ..... A47B 3/0916 108/133

(Continued)

FOREIGN PATENT DOCUMENTS

DE 20009546 U1 * 8/2000 ..... F24C 15/04
DE 10163150 A1 * 7/2002 ..... F24C 15/02

(Continued)

OTHER PUBLICATIONS

German to English machine translation of DE10163150A1.*

(Continued)

*Primary Examiner* — Michael G Hoang
*Assistant Examiner* — Elizabeth Ann Laughlin
(74) *Attorney, Agent, or Firm* — Michael E. Tschupp; Andre Pallapies; Brandon G. Braun

(57) ABSTRACT

A door for a household cooking appliance includes an outer pane, an inner pane dismountable from the door, an intermediate pane arranged between the outer pane and the inner pane and dismountable from the door, and a sealing facility arranged at least in one portion between the inner pane and the intermediate pane. When the inner pane is dismounted, the sealing facility is pivotable from a folded-in state in which the sealing facility is in contact with the intermediate pane into a folded-out state in which the sealing facility is not in contact with the intermediate pane.

17 Claims, 14 Drawing Sheets

(58) Field of Classification Search
USPC ..... 126/190
See application file for complete search history.

(56) References Cited

U.S. PATENT DOCUMENTS

| | | | | |
|---|---|---|---|---|
| 3,244,165 | A * | 4/1966 | Buck | F24C 15/021 126/200 |
| 2011/0044754 | A1 | 2/2011 | Bronstering | |
| 2021/0108803 | A1 * | 4/2021 | Johnson | F24C 15/325 |

FOREIGN PATENT DOCUMENTS

| | | | | |
|---|---|---|---|---|
| DE | 10143920 | A1 | 4/2003 | |
| DE | 10143928 | A1 | 5/2003 | |
| DE | 102008029320 | B3 * | 7/2009 | E05D 5/0246 |
| DE | 102010041027 | A1 * | 3/2012 | F24C 15/045 |
| EP | 1308676 | A2 * | 5/2003 | F24C 15/04 |
| EP | 2921784 | A1 | 9/2015 | |
| FR | 2599478 | A3 | 12/1987 | |

OTHER PUBLICATIONS

German to English machine translation of DE102008029320B3.*
German to English machine translation of DE102010041027A1.*
German to English machine translation of DE20009546U1.*
German to English machine translation of EP1308676A2.*
German to English translation of International Search Report PCTEP2021068827 (Year: 2021).*
Merriam Webster, Attach Definition, 1 page, https://www.merriam-webster.com/dictionary/attach.*
National Search Report DE 102020209240.0 dated Feb. 23, 2021.
International Search Report PCT/EP2021/068847 dated Sep. 21, 2021.

* cited by examiner

DOOR AND DOMESTIC COOKING DEVICE

CROSS-REFERENCES TO RELATED APPLICATIONS

This application is the U.S. National Stage of International Application No. PCT/EP2021/068847, filed Jul. 7, 2021, which designated the United States and has been published as International Publication No. WO 2022/017798 A1 and which claims the priority of German Patent Application, Serial No. 10 2020 209 240.0, filed Jul. 22, 2020, pursuant to 35 U.S.C. 119(a)-(d).

BACKGROUND OF THE INVENTION

The present invention relates to a door for a household cooking appliance and a household cooking appliance comprising such a door.

A household cooking appliance can have a cooking chamber comprising a door which is pivotably attached to the cooking chamber. The door can have an inner pane facing the cooking chamber, an outer pane facing away from the cooking chamber and an intermediate pane arranged between the inner pane and the outer pane. In household cooking appliances with ventilated doors it can be necessary to dismantle the door in order to clean the inner pane and the intermediate pane. Thus it is desirable for the door to be able to be easily dismantled.

BRIEF SUMMARY OF THE INVENTION

Against this background, it is an object of the present invention to provide an improved door for a household cooking appliance.

Accordingly, a door for a household cooking appliance is proposed. The door comprises an outer pane, an inner pane, an intermediate pane arranged between the outer pane and the inner pane, and a sealing facility which is arranged at least in some portions between the inner pane and the intermediate pane, wherein the inner pane and the intermediate pane can be dismounted from the door and wherein, when the inner pane is dismounted, the sealing facility can be pivoted from a folded-in state in which the sealing facility is in contact with the intermediate pane into a folded-out state in which the sealing facility is not in contact with the intermediate pane.

As the sealing facility can be pivoted from the folded-in state into the folded-out state, it is possible to dismount the inner pane without having to remove the sealing facility from the door. The sealing facility is thus captively connected to the door.

The household cooking appliance can be a stove, an oven, a microwave combination oven, a double oven, or the like. Preferably, the household cooking appliance comprises a cooking chamber to which the door, for example, is pivotably attached. Hinges can be provided therefor. The hinges can be coupled to a door support of the door. However, this is not absolutely necessary. Alternatively, the door can also be arranged on an oven carriage or the like, which can be pulled out of the cooking chamber. In this case, the door is not pivotably attached to the cooking chamber but is displaceable relative thereto in a linear manner.

In particular, the door comprises a door support. The door support is arranged, in particular, between the inner pane and the outer pane. The door support, in particular, is fixedly connected to the outer pane. Preferably, two door supports are provided, namely a first door support and a second door support, which are fixedly connected to the outer pane. The door supports are attached to the outer pane at the side and when the door is closed run in a y-direction or vertical direction of the household cooking appliance or the door. The door supports are attached to the outer pane on the rear face, for example adhesively bonded thereto.

The door is able to be dismounted from the cooking chamber so that the door can be dismantled and reassembled in its state dismounted from the cooking chamber. Moreover, the door can also be dismantled and reassembled in a state mounted on the cooking chamber. The sealing facility can also be denoted as a seal or sealing strip.

Any number of intermediate panes can be provided between the outer pane and the inner pane. At least one intermediate pane is provided. However, two or three intermediate panes can be arranged between the outer pane and the inner pane. The intermediate panes and the inner pane can be dismounted. The outer pane, the inner pane and the intermediate pane are preferably transparent at least in some portions. The outer pane, the inner pane and the intermediate pane or the intermediate panes together form a pane pack which can be compressed. To this end, damping elements which are elastically deformable can be provided between the panes. The intermediate pane or the intermediate panes can be produced from glass, a sol-gel, a polycarbonate, or the like. Alternatively, the intermediate pane or the intermediate panes can be configured as a screen made of metal, non-ferrous metal or plastic.

A gap or intermediate space is provided between the inner pane and the intermediate pane, said gap being separated from other hollow spaces or intermediate spaces of the door by means of the sealing device. As a result, a stationary air cushion can be achieved in the intermediate space provided between the inner pane and the intermediate pane. A thermal insulation of the door can be achieved by means of the stationary air cushion. In particular, the thermal load of the door support can be significantly reduced. Moreover, the household cooking appliance is also more energy-efficient due to the thermal insulation.

In the present case, the sealing facility being arranged at least "in some portions" between the inner pane and the intermediate pane does not preclude that parts or portions of the sealing facility are not arranged between the inner pane and the intermediate pane. In the folded-in state, the sealing facility bears against the intermediate pane. As long as the inner pane is mounted, the sealing facility also bears against the inner pane. In the folded-out state, the sealing facility is no longer in contact with the intermediate pane.

According to one embodiment, the door further comprises a door support which is fixedly connected to the outer pane.

A "fixed" connection in the present case can be understood to mean a positive connection, a non-positive connection or a material connection. For example, the door support is adhesively bonded or screwed to the outer pane, or suspended therein. "Fixed", however, does not preclude that the connection can be separated again. Thus, for example, a positive connection can be released again without damaging the door support or the outer pane. As mentioned above, preferably two door supports are provided. Preferably, the door support is adhesively bonded to the outer pane. As a result, a reliable connection of the door support to the outer pane is ensured.

According to a further embodiment, the at least one door support is produced from a plastic material.

Alternatively, the door support can also be produced from a metal. For example, the door support is produced from an acrylonitrile butadiene styrene (ABS), in particular from a fiber-reinforced ABS. Alternatively, any other plastic material can also be used. By the use of a plastic material for the door support, it can be manufactured cost-effectively as a plastic injection-molded component.

According to a further embodiment, the door comprises a first door support and a second door support, wherein each door support comprises a sealing facility.

Preferably, as explained above, a further sealing facility is provided between the door supports, in each case on an upper edge and on a lower edge of the door. As a result, the intermediate space provided between the inner pane and the intermediate pane can be closed entirely over the periphery.

According to a further embodiment, the sealing facility is fixedly connected to the at least one door support.

In other words, it is not necessary to remove the sealing facility from the door support in order to dismount the inner pane and the intermediate pane. The sealing facility is thus captively connected to the door support. This improves the handling. The sealing facility, however, can also be connected to any other door support element, for example to a frame or any other component of the door.

According to a further embodiment, the sealing facility is mounted on a component of the door, in particular on the at least one door support, so as to be pivotable about an axis of rotation.

The axis of rotation is preferably arranged in or on the door support. The axis of rotation is arranged, in particular, outside the intermediate space provided between the inner pane and the intermediate pane. The sealing facility could also be produced from a shaped flat steel, an individually shaped sealing profile, for example an extrusion profile made of silicone rubber, being mounted thereon.

According to a further embodiment, the sealing facility comprises cylindrical bearing portions which are mounted in recesses of the at least one door support, so as to be rotatable about the axis of rotation.

The cylindrical bearing portions are, in particular, hollow-cylindrical. The cylindrical bearing portions can be produced from a metal sheet. Preferably, the sealing facility is a bent sheet metal part and comprises a base portion, the first sealing portion extending therefrom. The second sealing portion extends out of the first sealing portion. The bearing portions are integrally formed on the base portion which can be integrally formed perpendicular to the first sealing portion. In particular, a first bearing portion and a second bearing portion are provided.

According to a further embodiment, when pivoted from the folded-in state into the folded-out state, the sealing facility is latched to the at least one door support so that the sealing facility automatically remains in the folded-out state.

To this end, a snap portion or latching portion, which cooperates by means of a rib or latching lug provided on the door support, can be provided on the sealing facility. As the sealing facility automatically remains in the folded-out state, it is possible to mount the inner pane in a simpler manner since the sealing facility is not able to move automatically back into the folded-in state. The sealing facility can be moved from the folded-out state back into the folded-in state only by the application of a force.

According to a further embodiment, when the inner pane is mounted, the sealing facility is pressed between the inner pane and the intermediate pane.

In other words, when the inner pane is mounted, the sealing facility is elastically, in particular spring-elastically, deformed. In other words, the sealing facility can be moved from an undeformed state into a deformed state by the application of a force, for example by the positioning of the inner pane and by a completion of a door assembly. As soon as forces no longer act on the sealing facility, for example as soon as the inner pane is lifted away, the sealing facility changes shape from the deformed state automatically back into the, in particular, approximately undeformed state.

According to a further embodiment, the sealing facility comprises a first sealing portion which bears against the intermediate pane when the inner pane is mounted and a second sealing portion which bears against the intermediate pane when the inner pane is mounted.

The first sealing portion and the second sealing portion are preferably connected together on a bent portion. Preferably, the sealing facility is a bent sheet metal component.

According to a further embodiment, the first sealing portion and the second sealing portion are arranged in a V-shaped manner.

By means of the V-shaped geometry, the first sealing portion and the second sealing portion form a spring which is deformed in a spring-elastic manner when the inner pane is positioned on the sealing facility.

According to a further embodiment, the sealing facility comprises a cylindrical sealing portion.

The sealing portion is, in particular, circular-cylindrical or roller-shaped. The sealing portion can be threaded onto a wire which is pivotably connected to the door support. In this case, the sealing portion is preferably produced from an elastically deformable material, such as for example a silicone material. The sealing portion can have a plurality of recesses running along the sealing portion. These recesses facilitate the deformability of the sealing portion.

According to a further embodiment, the sealing facility is produced from a metal sheet, from glass fiber or from a silicone material.

In the case that the sealing facility is produced from a metal sheet, as already mentioned above, this is a bent sheet metal component. If the sealing facility is produced from glass fiber or from a silicone material, this sealing facility comprises the above-mentioned sealing portion which is produced from the glass fiber or from the silicone material. The sealing portion is preferably threaded onto a wire or the like, which is pivotably connected to the door support.

According to a further embodiment, the intermediate pane is able to be dismounted from the door only when the sealing facility is pivoted into the folded-out state.

In other words, as long as the sealing facility is in the folded-in state, this sealing facility blocks the intermediate pane so that this intermediate pane cannot be dismounted.

A household cooking appliance comprising a cooking chamber and a door which is attached to the cooking chamber is further proposed.

The household cooking appliance, as mentioned above, can be a stove, an oven, a microwave combination oven, a double oven, or the like. "Attached" in the present case means that the door is connected to the cooking chamber, for example, so as to be vertically or horizontally pivotable. Alternatively, the door can also be arranged on an oven carriage which can be extended out of the cooking chamber. In this case, the door is not pivotably mounted on the cooking chamber but is displaceable or movable relative thereto in a linear manner. However, the door can also perform any movement when opened.

Further possible implementations of the door and/or the household cooking appliance also comprise not explicitly mentioned combinations of features or embodiments described above or below relative to the exemplary embodiments. In this case, the person skilled in the art will also add individual aspects as improvements or additions to the respective basic form of the door and/or the household cooking appliance.

BRIEF DESCRIPTION OF THE DRAWINGS

Further advantageous embodiments and aspects of the door and/or the household cooking appliance form the subject matter of the subclaims and the exemplary embodiments of the door and/or the household cooking appliance described below. The door and/or the household cooking appliance are explained in more detail hereinafter by way of preferred embodiments with reference to the accompanying figures.

DETAILED DESCRIPTION OF EXEMPLARY EMBODIMENTS OF THE PRESENT INVENTION

Elements which are the same or functionally the same have been provided with the same reference signs in the figures, unless specified otherwise.

Figure 1:
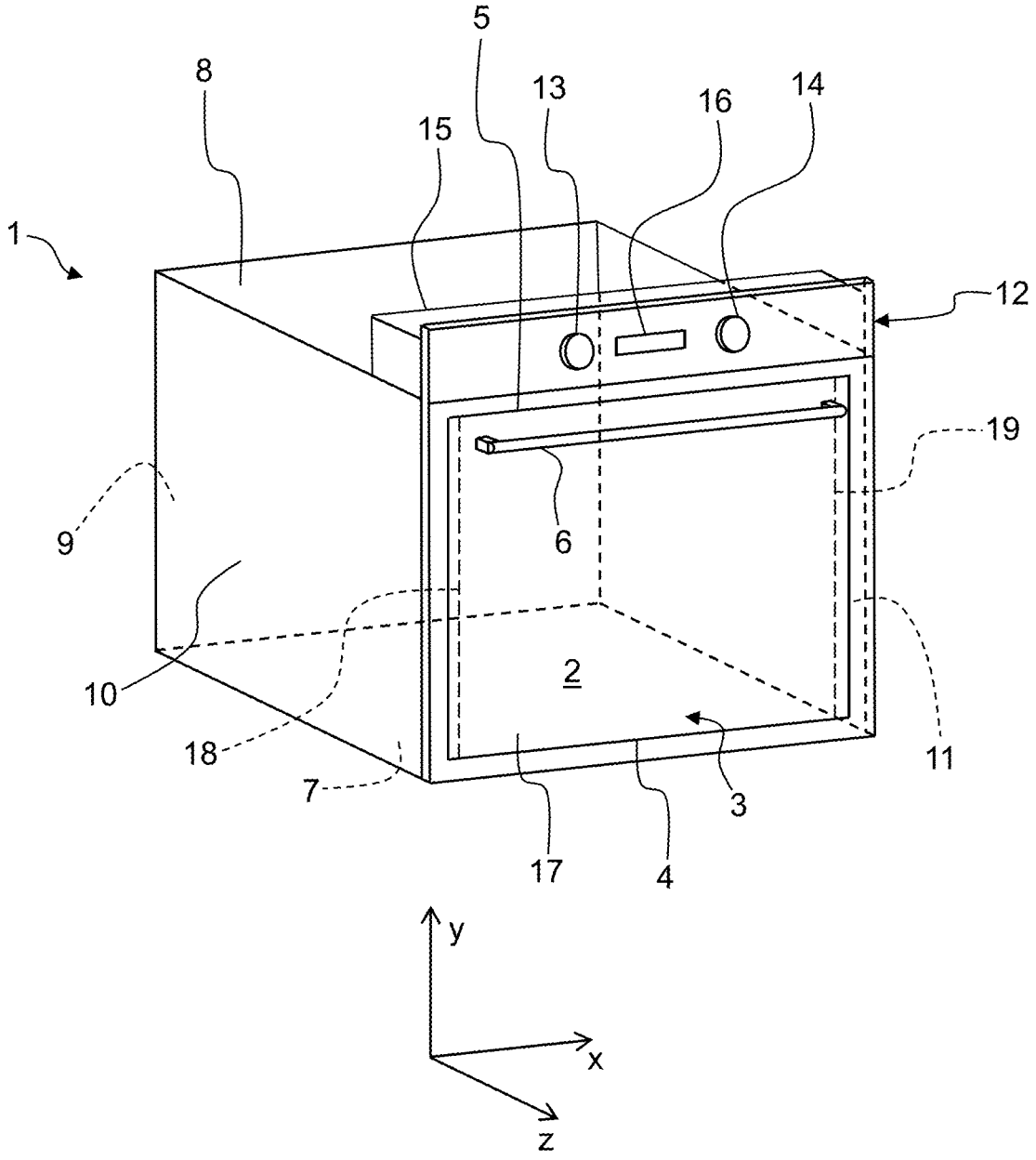
FIG. 1 shows a schematic perspective view of an embodiment of a household cooking appliance.

FIG. 1 shows a schematic perspective view of an embodiment of a household cooking appliance 1. The household cooking appliance 1 can be a stove, an oven, a microwave combination oven, a double oven, or the like. The household cooking appliance 1 has a cooking chamber 2 which can be closed by means of a door 3. The cooking chamber 2 can also be denoted as a muffle or oven muffle. The cooking chamber 2 can be arranged in the interior of a housing of the household cooking appliance 1. The door 3 is shown in FIG. 1 in its closed position. The door 3 can be closed or opened by pivoting about a pivot axis provided at a lower end of the door 3 or a lower edge 4 of the door 3. Alternatively, the door 3 can be attached to the cooking chamber 2 at the side. Moreover, the door 3 can be arranged on an oven carriage which can be pulled out of the cooking chamber 2. However, it is possible to select any type of movement of the door 3 for opening the door 3. In other words, in principle the door 3 can perform any movement when opened.

A handle 6 can be provided on an upper portion or on an upper edge 5 of the door 3. The cooking chamber 2 has a bottom 7, a ceiling 8 arranged opposite the bottom 7, a rear wall 9 arranged opposite the closed door 3 and two side walls 10, 11 arranged opposite one another. The cooking chamber 2 is preferably cuboidal or cube-shaped. The cooking chamber 2 can be produced from a metal material, in particular from a steel sheet.

The household cooking appliance 1 also comprises control knobs 13, 14 provided on a switch panel or control panel 12. The control knobs 13, 14 can be, for example, rotatable. A control facility 15, only shown schematically, can be provided on the rear face on the control panel 12 for controlling the household cooking appliance 1. The control facility 15 can be a regulating facility and/or control facility. A display 16 can also be provided on the control panel 12. An operating state of the household cooking appliance 1 can be displayed by means of the display 16. For example, a temperature set by means of one of the control knobs 13, 14 can be displayed by means of the display 16.

The household cooking appliance 1 can be capable of pyrolysis. In other words, the cooking chamber 2 can be burnt out by means of a correspondingly high temperature. Dirt adhering to the cooking chamber 2 and to the door 3 on the inner face is carbonized thereby, so that this dirt either drops off automatically or can be easily removed. However, this pyrolysis function is not absolutely necessary. The door 3 is a ventilated door. In other words, an air flow is conducted through the door 3.

A coordinate system having a width direction or x-direction x, a vertical direction or y-direction y, and a depth direction or z-direction z is assigned to the household cooking appliance 1 or the door 3. The directions x, y, z are oriented perpendicular to one another. The door 3 comprises an outer pane 17 which is located in a plane spanned by the x-direction x and the y-direction y. On the rear face, i.e. facing the cooking chamber 2, a first door support 18 and a second door support 19 are attached to the outer pane 17. When the door 3 is closed, the door supports 18, 19 run in the y-direction y. The door supports 18, 19 are preferably adhesively bonded to the outer pane 17 on the rear face. The door supports 18, 19 are produced from a plastic material. Hinges, not shown, can be attached to the door supports 18, 19 so that the door 3 can be pivotably attached to the cooking chamber 2.

Figure 2:
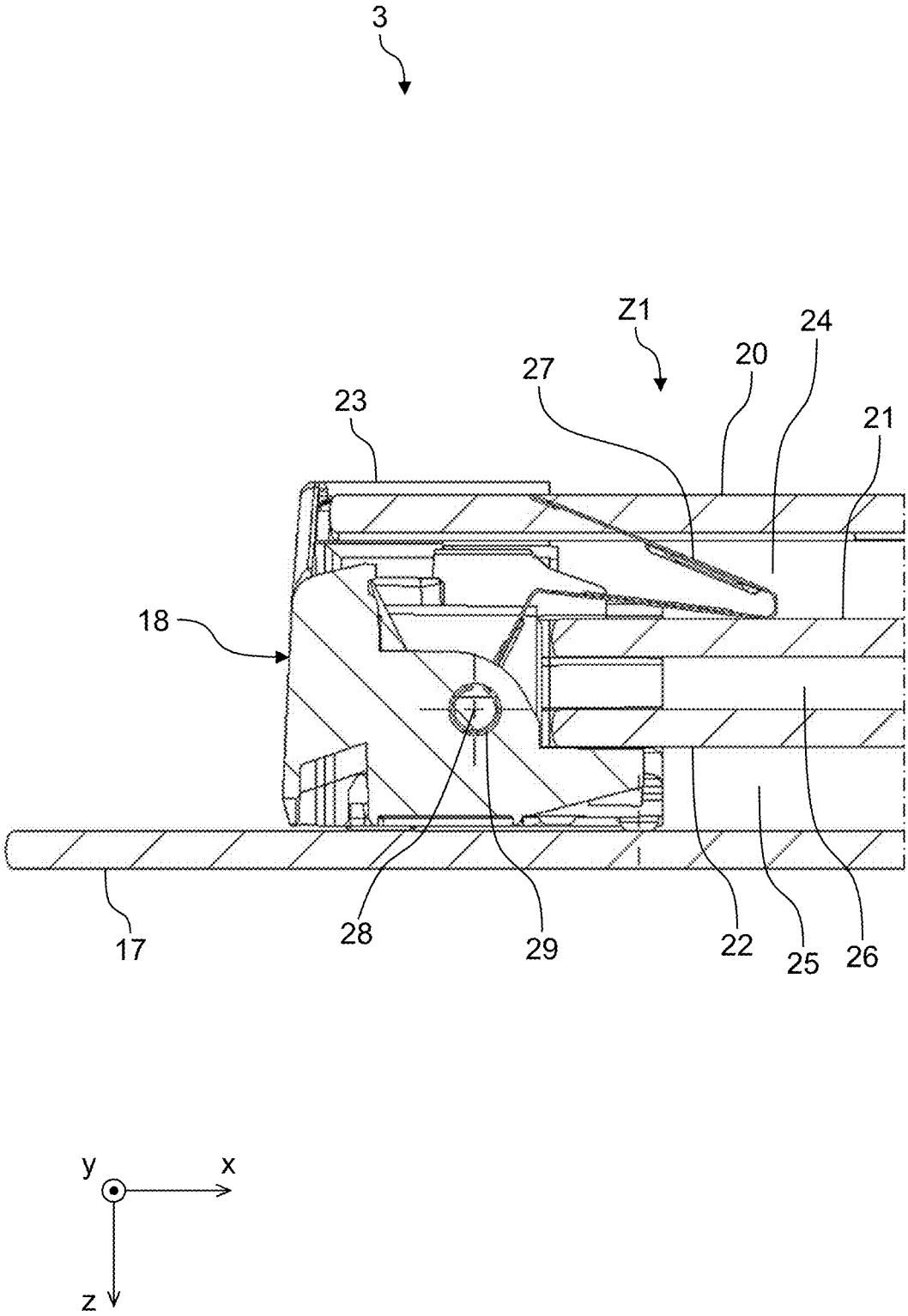
FIG. 2 shows a schematic partial sectional view of an embodiment of a door for the household cooking appliance according to FIG. 1.
Figure 3:
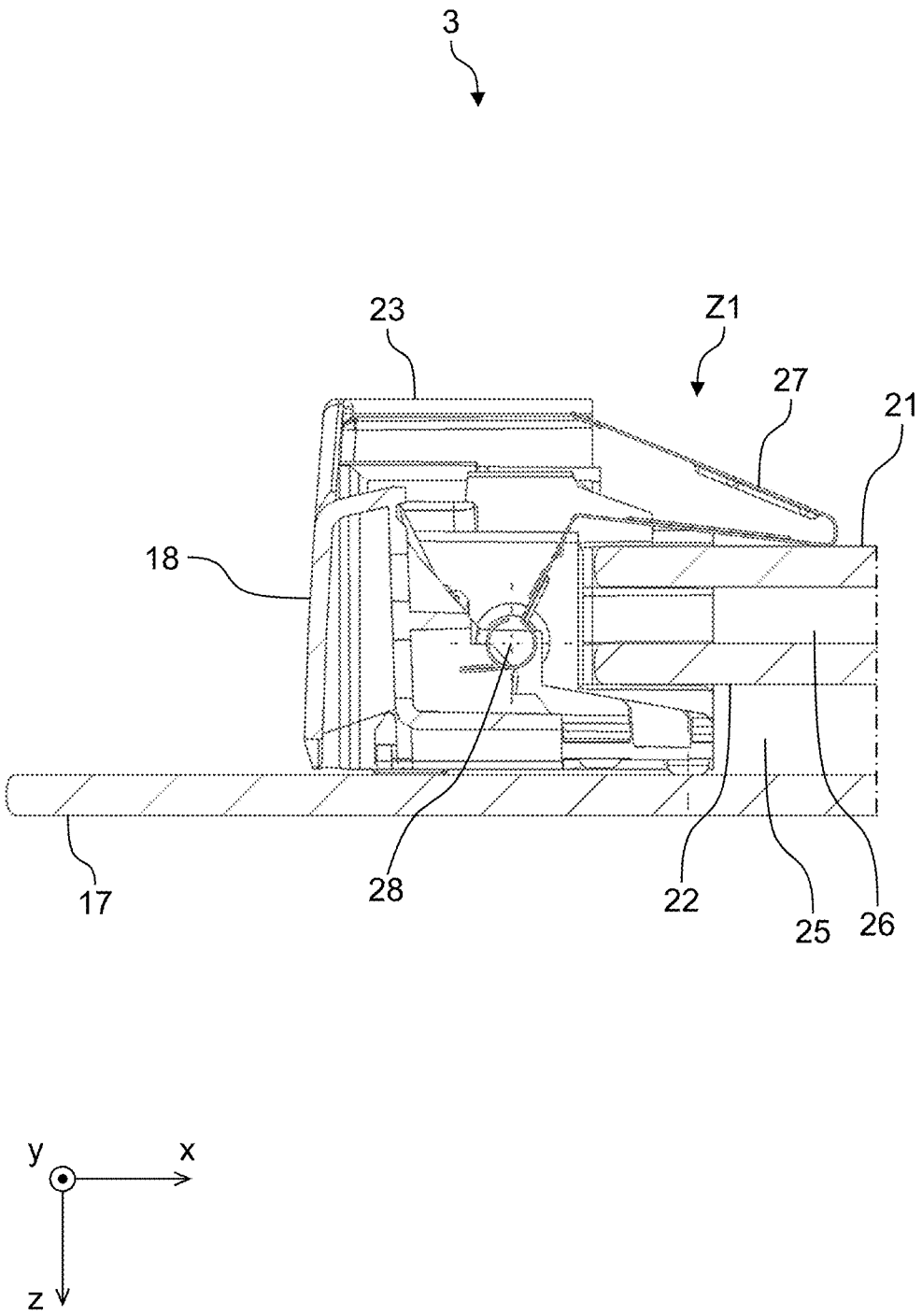
FIG. 3 shows a further schematic partial sectional view of the door according to FIG. 2.
Figure 4:
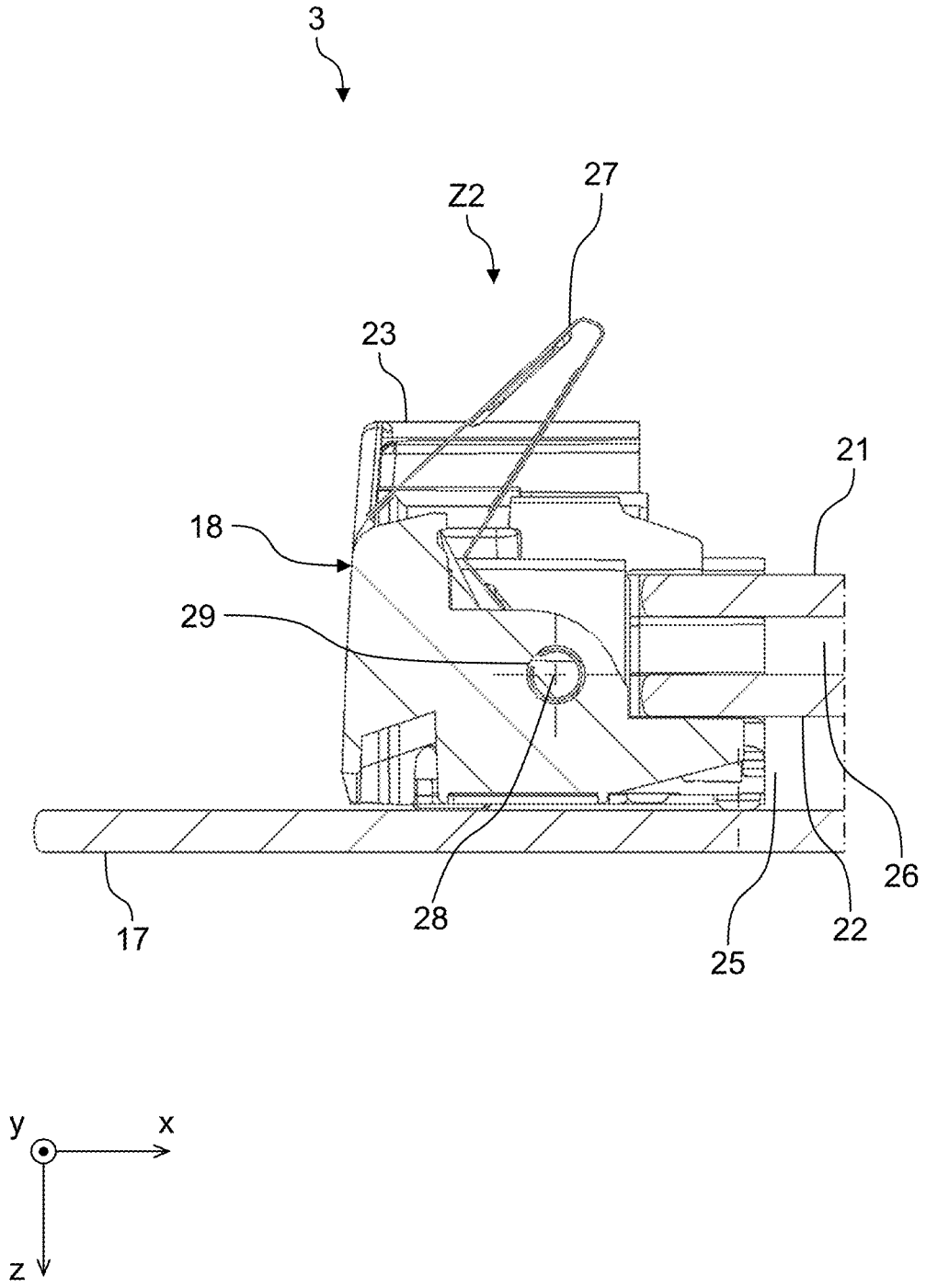
FIG. 4 shows a further schematic partial sectional view of the door according to FIG. 2.
Figure 5:
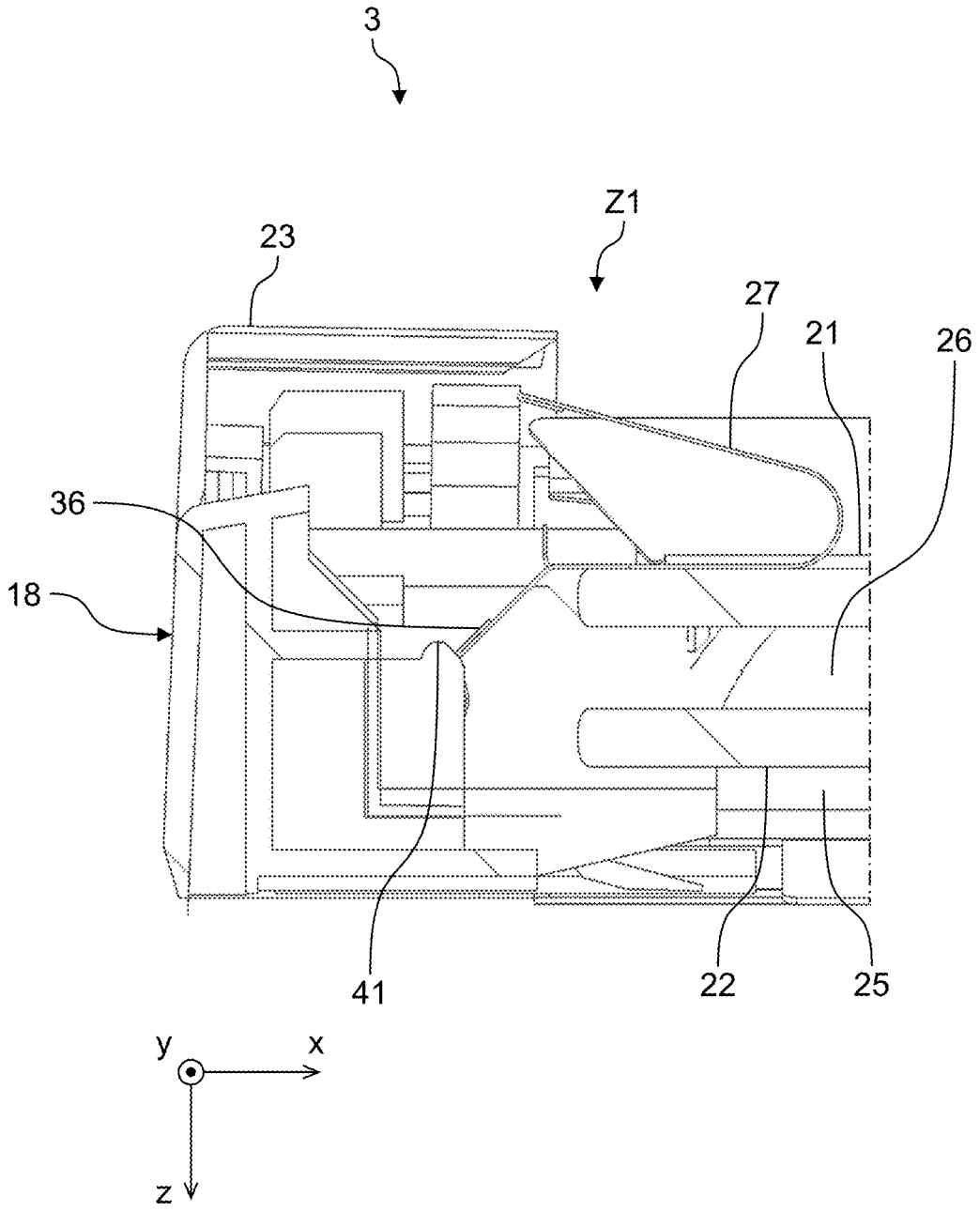
FIG. 5 shows a further schematic partial sectional view of the door according to FIG. 2.

FIG. 2 shows a schematic partial sectional view of an embodiment of a door 3, as mentioned above. FIG. 3 shows a further schematic partial sectional view of the door 3. FIG. 4 shows a further schematic partial sectional view of the door 3. FIG. 5 shows a further schematic partial sectional view of the door 3, wherein a cutting plane which intersects the door 3 is positioned in the y direction y, approximately at half the height of the household cooking appliance 1. Reference is made hereinafter to FIGS. 2 to 5 at the same time.

As mentioned above, the door 3 comprises the outer pane 17, the door supports 18, 19, of which only the first door support 18 is shown in FIGS. 2 to 5, being adhesively bonded thereto on the rear face. In addition to the outer pane 17, the door 3 comprises an inner pane 20 facing the cooking chamber 2. A first intermediate pane 21 and a second intermediate pane 22 are provided between the outer pane 17 and the inner pane 20. In principle, there can be any number of intermediate panes 21, 22.

The first intermediate pane 21 is arranged closer to the inner pane 20 than the second intermediate pane 22. Accordingly, the second intermediate pane 22 is arranged closer to the outer pane 17 than the first intermediate pane 21. The inner pane 20 is held by a locking facility 23 which is displaceable along the first door support 18. The locking facility 23 can be denoted as a sliding cap. During the operation of the household cooking appliance 1, in particular in pyrolysis mode, air can circulate between the outer pane 17 and the second intermediate pane 22 or between the first intermediate pane 21 and the second intermediate pane 22. At the same time, dirt can be deposited on the outer pane 17, the intermediate panes 21, 22 and the inner pane 20. Thus, as is explained in more detail below, a user can remove the inner pane 20 and the intermediate panes 21, 22 from the door 3 for cleaning.

Preferably no air circulates between the inner pane 20 and the first intermediate pane 21. In other words, a stationary air cushion is provided between the inner pane 20 and the first intermediate pane 21 in an intermediate space 24 which is provided between the inner pane 20 and the first intermediate pane 21. The intermediate space 24 can also be denoted as a gap. The stationary air cushion is achieved by it being sealed relative to an intermediate space 25 between the outer pane 17 and the second intermediate pane 22 through which air flows, and relative to an intermediate space 26 between the first intermediate pane 21 and the second intermediate pane 22 through which air flows. The intermediate spaces 25, 26 can also be denoted as gaps.

For sealing the intermediate space 24, a sealing facility 27 which is arranged at least in some portions in the intermediate space 24 is provided between the first intermediate pane 21 and the inner pane 20. Preferably, a plurality of such sealing facilities 27 can be provided. In this case, such a sealing facility 27 is assigned to each door support 18, 19. Moreover, in each case the lower edge 4 and the upper edge 5 can also be assigned such a sealing facility 27. As a result, the intermediate space 24 can be entirely sealed over the periphery. However, reference is made only to the first door support 18 hereinafter.

The sealing facility 27 is mounted on the first door support 18 so as to be pivotable about an axis of rotation 28 which runs parallel to the y-direction y. After removing the inner pane 20, the sealing facility 27 can be moved from a folded-in state Z1 (FIG. 3), in which the sealing facility 27 is supported on the first intermediate pane 21, about the axis of rotation 28 into a folded-out state Z2 (FIG. 4) in which the sealing facility 27 has no contact with the first intermediate pane 21. If the sealing facility 27 is in the folded-in state Z1, as shown in FIG. 2, the inner pane 20 can be positioned on the sealing facility 27 which, in contrast to that shown in FIG. 2, then deforms spring-elastically and bears against the inner pane 20 on the inner face. The first door support 18 comprises two recesses 29, of which only one is shown however in FIGS. 2 and 4, in which the sealing facility 27 is rotatably mounted about the axis of rotation 28.

Figure 6:
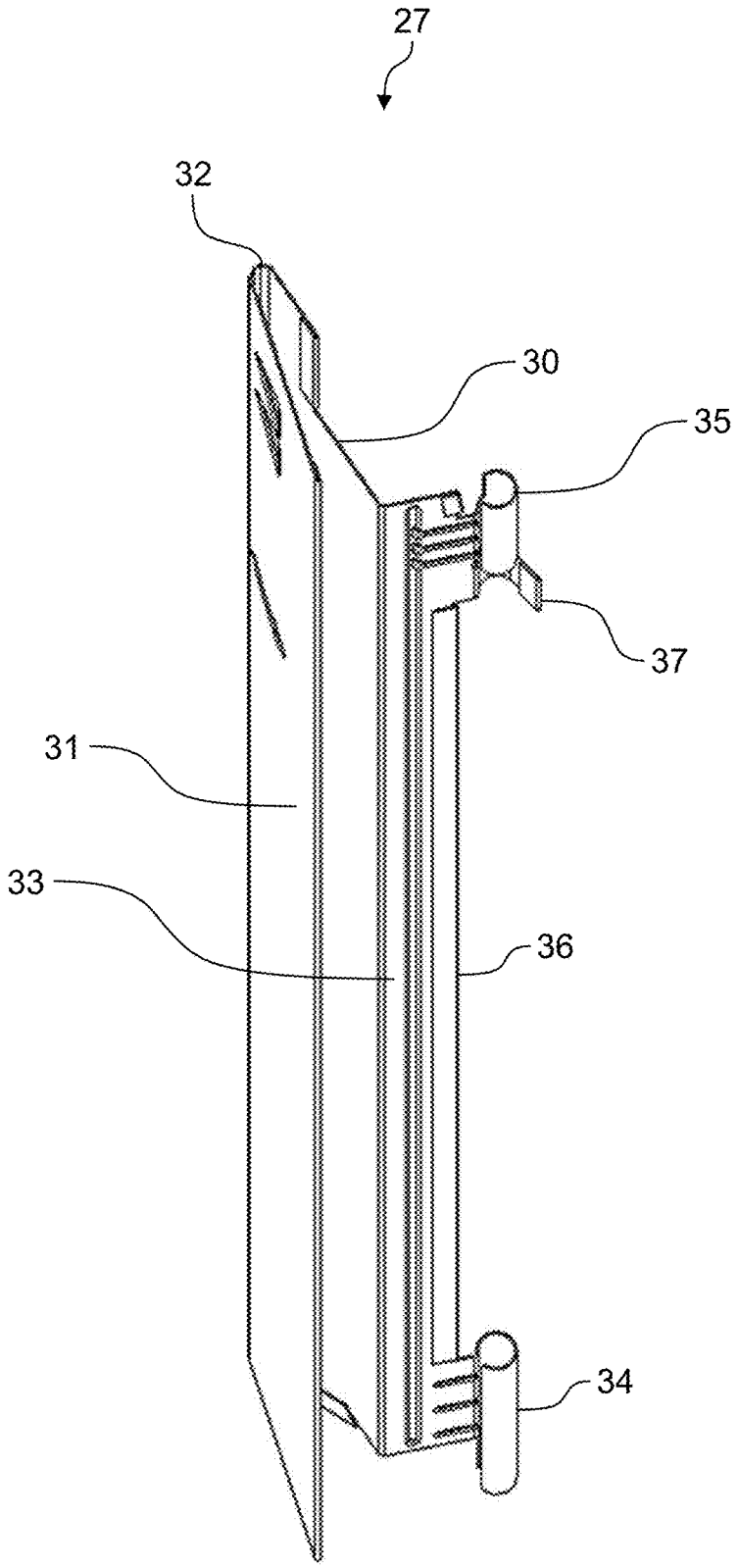
FIG. 6 shows a schematic perspective view of an embodiment of a sealing facility for the door according to FIG. 2.

FIG. 6 shows a schematic perspective view of an embodiment of a sealing facility 27, as explained above. The sealing facility 27 is preferably produced from a metal sheet. Alternatively, the sealing facility 27 can also be produced from a plastic material, from glass fiber or from silicone. The sealing facility 27 is an integral component, in particular integrally formed from the same material. In the present case, "integral" or "one-piece" is to be understood to mean that the sealing facility 27 forms a single component which is not made up of different components. In the present case, "integrally formed from the same material" means that the sealing facility 27 is produced from the same material throughout. For example, the sealing facility 27 is a bent sheet metal component.

The sealing facility 27 comprises a first sealing portion 30 and a second sealing portion 31. The sealing portions 30, 31 are connected together on a bent portion 32. The sealing portions 30, 31 are arranged in V-shaped manner relative to one another and thus form a spring or a spring element which can be compressed by positioning the inner pane 20 on the door 3 in the z-direction z between the inner pane 20 and the first intermediate pane 21. The sealing facility 27 further comprises a strip-shaped base portion 33 which is preferably arranged perpendicular to the first sealing portion 30.

A lower or first bearing portion 34 which is assigned to the lower edge 4 of the door 3 is integrally formed on the base portion 33. The first bearing portion 34 is cylindrical, in particular hollow-cylindrical. Moreover, an upper or second bearing portion 35 which is assigned to the upper edge 5 of the door 3 is integrally formed on the base portion 33. The second bearing portion 35 is also cylindrical, in particular hollow-cylindrical. The bearing portions 34, 35 can be received in the recesses 29 of the first door support 18 so that the sealing facility 27 is pivotable relative to the first door support 18 about the axis of rotation 28 by means of the bearing portions 34, 35. A web portion 36 is provided between the bearing portions 34, 35. The web portion 36 can be an extension of the base portion 33. Moreover, a latching portion 37 is assigned to the second bearing portion 35. The latching portion 37 can be a web or the like, arranged perpendicular to the base portion 33.

Figure 7:
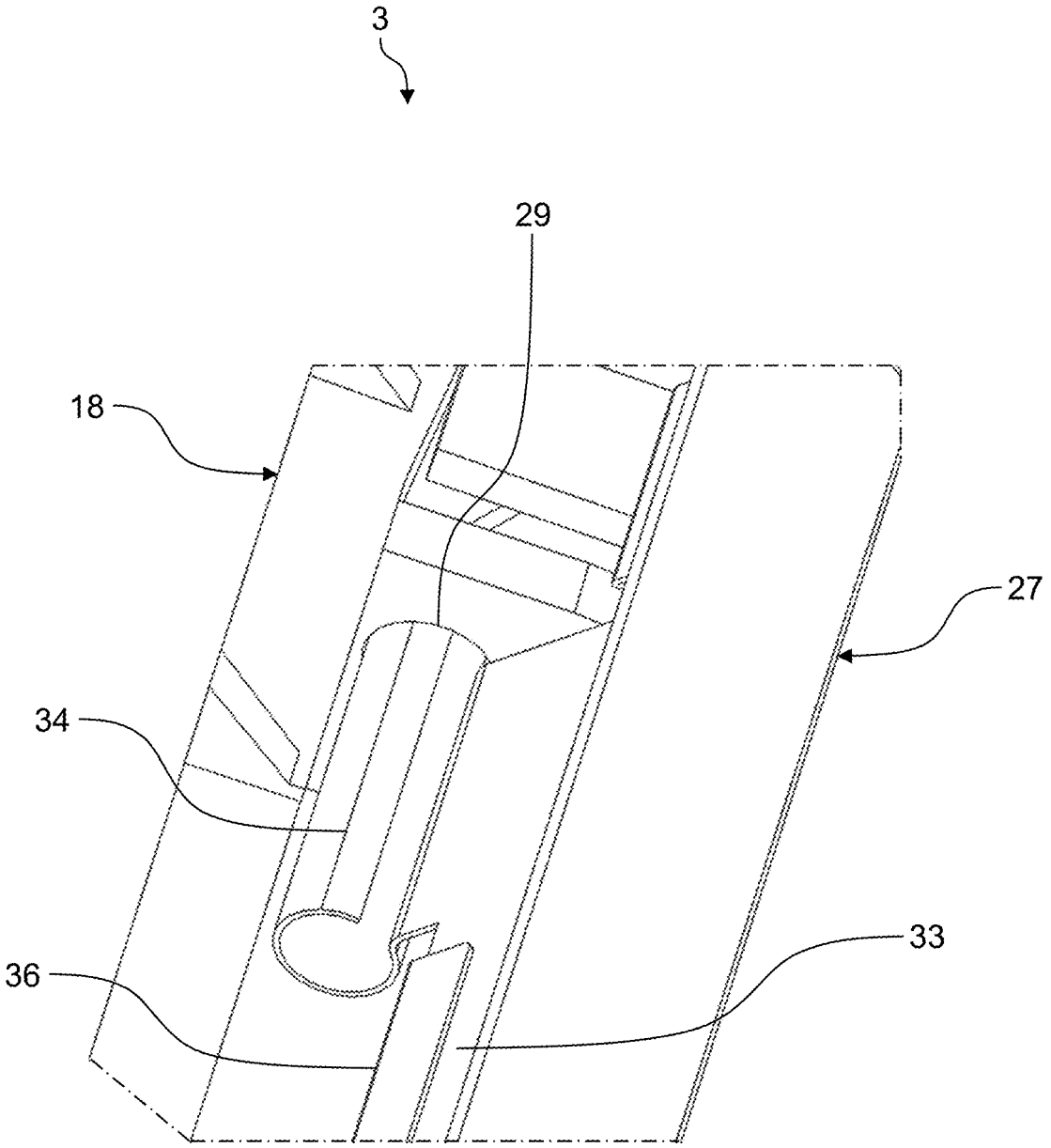
FIG. 7 shows a schematic perspective partial view of the door according to FIG. 2.
Figure 8:
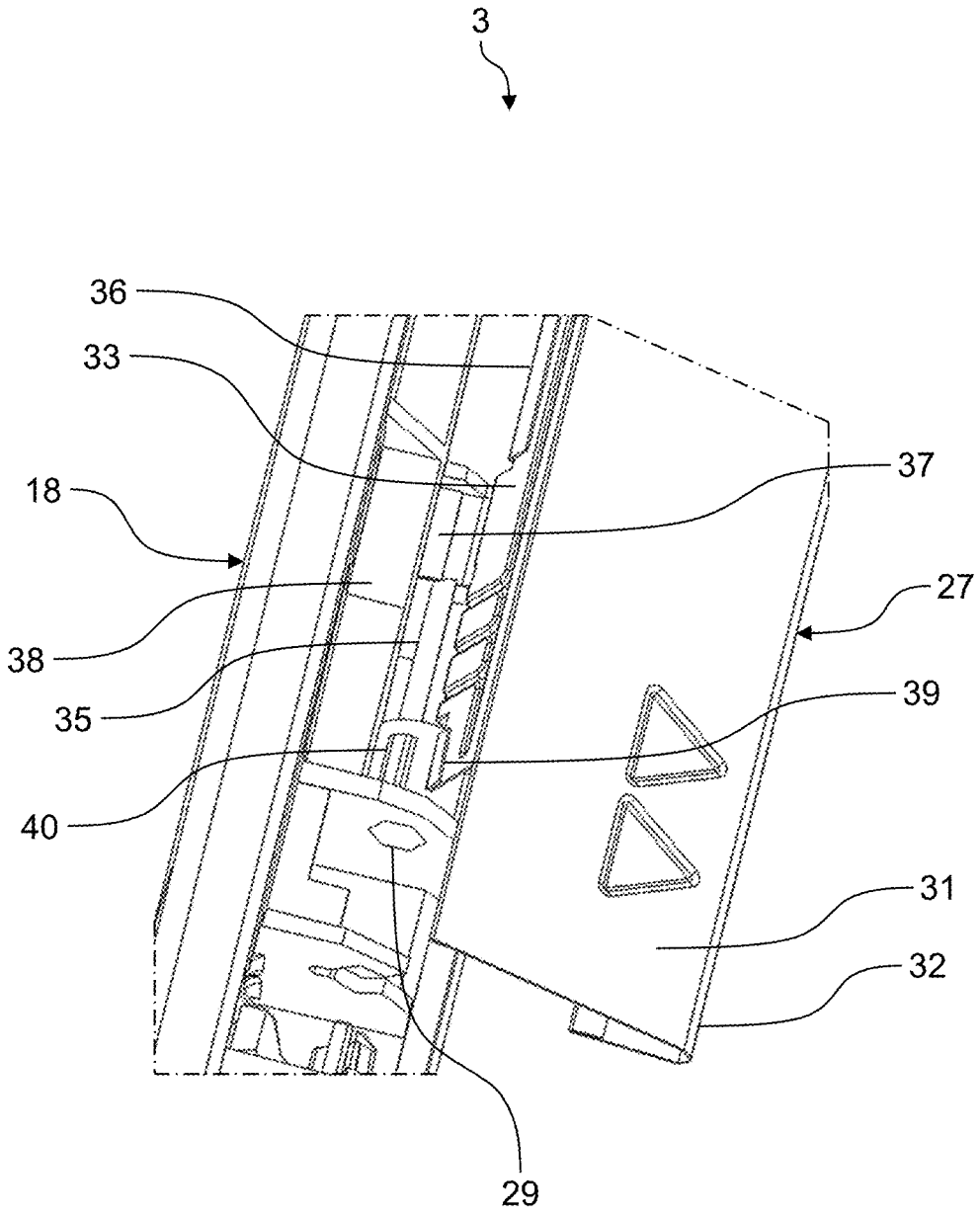
FIG. 8 shows a further schematic perspective partial view of the door according to FIG. 2.

FIG. 7 shows a schematic perspective partial view of the door 3. FIG. 8 shows a further schematic perspective partial view of the door 3. Reference is made hereinafter to FIGS. 7 and 8 at the same time. FIGS. 7 and 8 show the mounting of the sealing facility 27 on the first door support 18. Initially, the first bearing portion 34 is inserted into the recess 29 provided on the first door support 18. As mentioned above, the first bearing portion 34 is assigned to the lower edge 4 of the door 3. The first bearing portion 34 is inserted at the same time obliquely into the recess 29. Then the second bearing portion 35 is inserted into a corresponding further recess 29 of the first door support 18. In this case, the second bearing portion 35 is assigned to the upper edge 5 of the door 3.

After the first bearing portion 34 is inserted obliquely into the recess 29, the second bearing portion 35 is accordingly inserted in alignment into the recess 29 assigned to the upper edge 5 of the door 3. The sealing facility 27 is locked by means of the integrally formed latching portion 37 which is snapped behind a rib 38 which is integrally formed on the first door support 18 and thus connects the sealing facility 27 captively to the first door support 18. In this case, the latching portion 37 is spring-elastically deformed.

The sealing facility 27 can also comprise a further latching portion 39 which cooperates with a further rib 40 which is integrally formed on the first door support 18. When the sealing facility 27 is moved from the folded-in state Z1 into the folded-out state Z2, the latching portion 39 is latched in the rib 40 so that the sealing facility 27 remains in the folded-out state Z2 and does not automatically move back into the folded-in state Z1. Alternatively or additionally, a latching lug 41 (FIG. 5) which cooperates with the web portion 36 can be provided on the first door support 18. When the sealing facility 27 is moved from the folded-in state Z1 into the folded-out state Z2 the web portion 36 snaps over the latching lug 41, so that the sealing facility 27 is automatically held in the folded-out state Z2 and does not move back into the folded-in state Z1.

Figure 9:
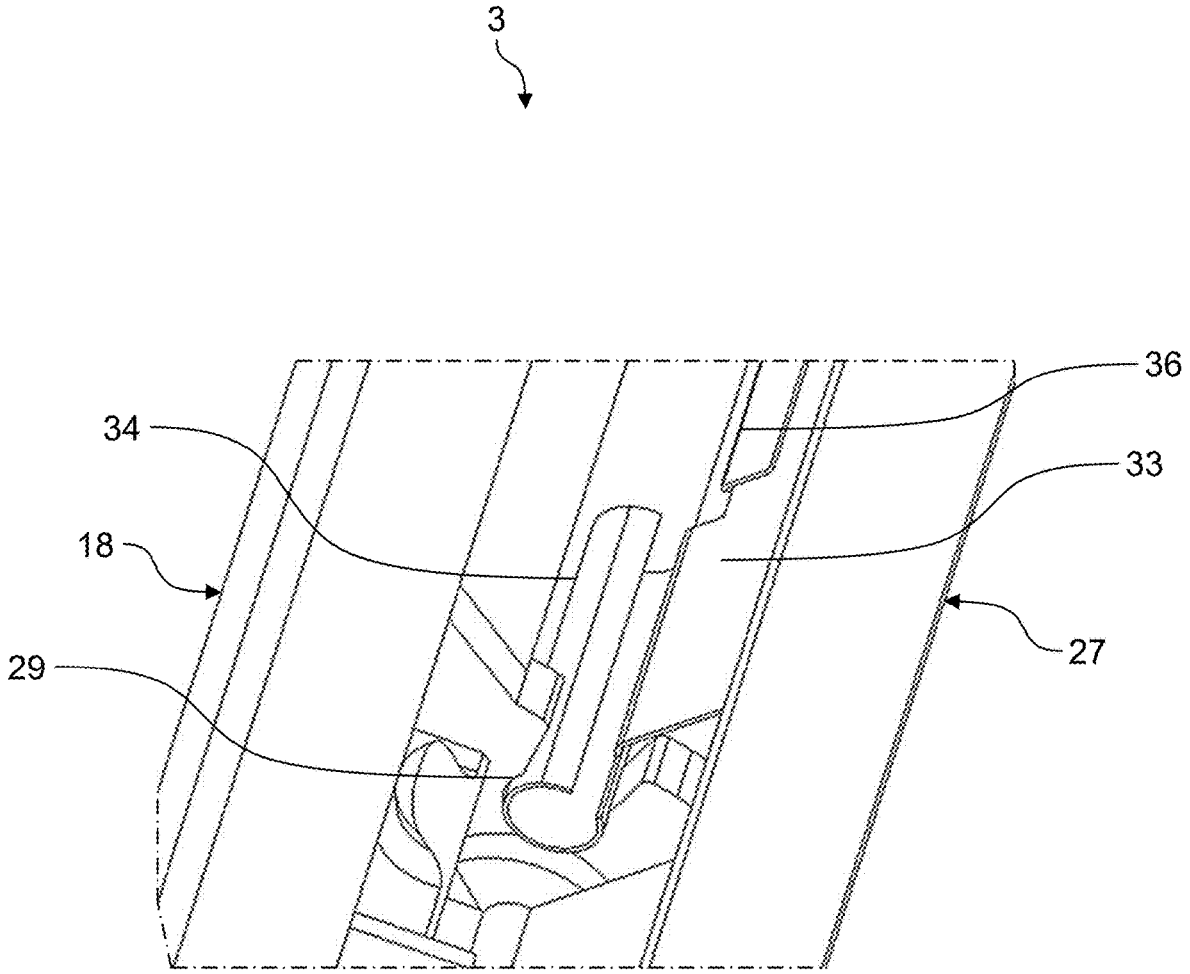
FIG. 9 shows a further schematic perspective partial view of the door according to FIG. 2.

FIG. 9 shows a further schematic perspective partial view of the door 3. In this development of the door 3, the recesses 29 provided on the first door support 18 are not closed but open over the periphery. As a result, the bearing portions 34, 35 can be pushed into the recesses 29 perpendicular to the axis of rotation 28. In this case, the bearing portions 34, 35 and/or the first door support 18 are spring-elastically deformed at least in some portions. This pushing-in of the bearing portions 34, 35 perpendicular to the axis of rotation 28 facilitates the mounting of the sealing facility 27 on the first door support 18.

The functionality of the sealing facility 27 is explained hereinafter. Initially, the inner pane 20 is unlocked by means of the locking facility 23. The inner pane 20 can then be lifted away from the door 3 or from the first door support 18. When lifting the inner pane 20 away from the door 3, the sealing facility 27 springs apart such that the first sealing portion 30 and the second sealing portion 31, as shown in FIGS. 2 to 4, form the V-shaped geometry. As long as the inner pane 20 is positioned on the sealing facility 27, this sealing facility is compressed, in contrast to that shown in FIG. 2, such that the sealing portions 30, 31 are moved toward one another. As a result, the sealing facility 27 can bear against the inner pane 20 on the inner face with a spring pretensioning.

As soon as the inner pane 20 is removed, the sealing facility 27 is pivoted from the folded-in state Z1 about the axis of rotation 28 into the folded-out state Z2. At the same time, the web portion 36 is latched over the latching lug 41, so that the sealing facility 27 automatically remains in the folded-out state Z2. Alternatively or additionally, the latching portion 37 of the sealing facility 27 is latched into the rib 40 of the first door support 18 or over this rib. After the sealing facility 27 is moved into the folded-out state Z2, the first intermediate pane 21 and the second intermediate pane 22 can be lifted away and removed from the door 3.

The assembly of the door 3 takes place in reverse. In this case, initially the second intermediate pane 22 is positioned onto the door 3. Then the first intermediate pane 21 is positioned. The sealing facility 27 is moved from the folded-out state Z2 back into the folded-in state Z1, so that the sealing facility 27 bears against the first intermediate pane 21. Then the inner pane 20 is positioned onto the sealing facility 27, wherein this sealing facility is spring-elastically deformed and braced between the first intermediate pane 21 and the inner pane 20.

Finally, the inner pane 20 is locked again to the first door support by means of the locking facility 23.

Figure 10:
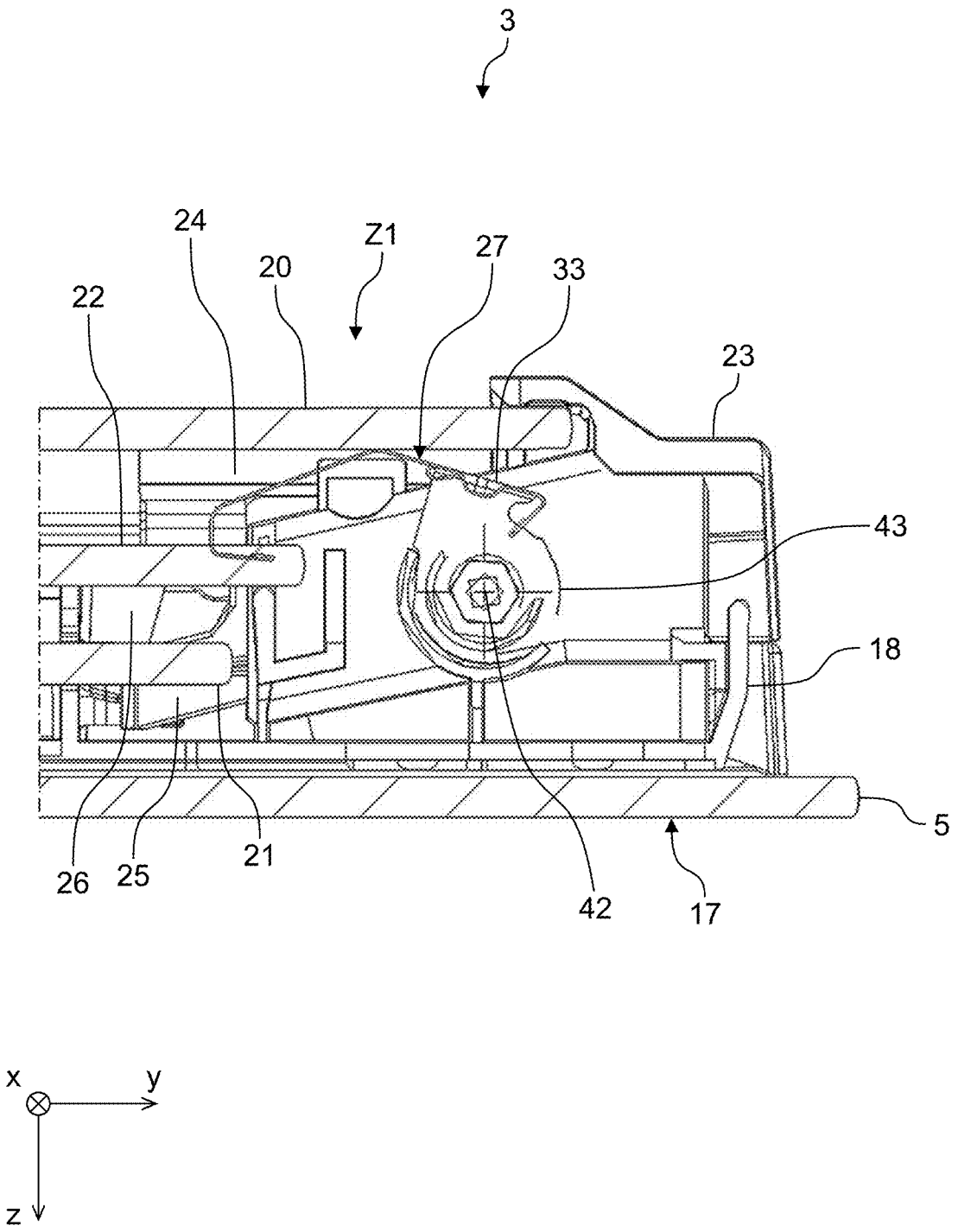
FIG. 10 shows a further schematic partial sectional view of the door according to FIG. 2.

FIG. 10 shows a further schematic partial sectional view of the door 3. As FIG. 10 shows, the door 3 comprises an upper or further sealing facility 27 on the upper edge 5. The lower edge 4 of the door 3 is also assigned a sealing facility 27, as shown in FIG. 10. The functionality of the sealing facility 27 according to FIG. 10 corresponds substantially to that of the above-explained sealing facility 27. The sealing facility 27 shown in FIG. 10 can be moved from a folded-in state Z1, shown in FIG. 10, into a folded-out state Z2, as explained above. The sealing facility 27 is mounted on the two door supports 18, 19 so as to be pivotable about an axis of rotation 42 which runs parallel to the x-direction x. The axis of rotation 42 is thus oriented perpendicular to the axis of rotation 28.

The sealing facility 27 is mounted by pushing onto open shaft portions which are attached to the two door supports 18, 19. The rotational movement of the sealing facility 27 is additionally guided by an externally located frame. An insertion bevel facilitates the mounting. A dismounting force of more than 20 N is achieved by a snap mechanism. A maximum deflection of the sealing facility 27, when the inner pane 20 and the intermediate panes 21, 22 are removed, prevents incorrect mounting without a sealing facility 27 being moved back into the folded-in state Z1. In the folded-out state Z2, for example, the sealing facility is blocked by a positive connection in the form of an eccentric geometry. The sealing facility 27 can comprise a cylindrical shaft portion 43 which is rotatably mounted on the above-mentioned shaft portions of the door supports 18, 19. The shaft portion 43 can be a plastic component extending parallel to the x-direction x. The shaft portion 43 is fixedly connected to a base portion 33 of the sealing facility 27, as explained above.

Figure 11:
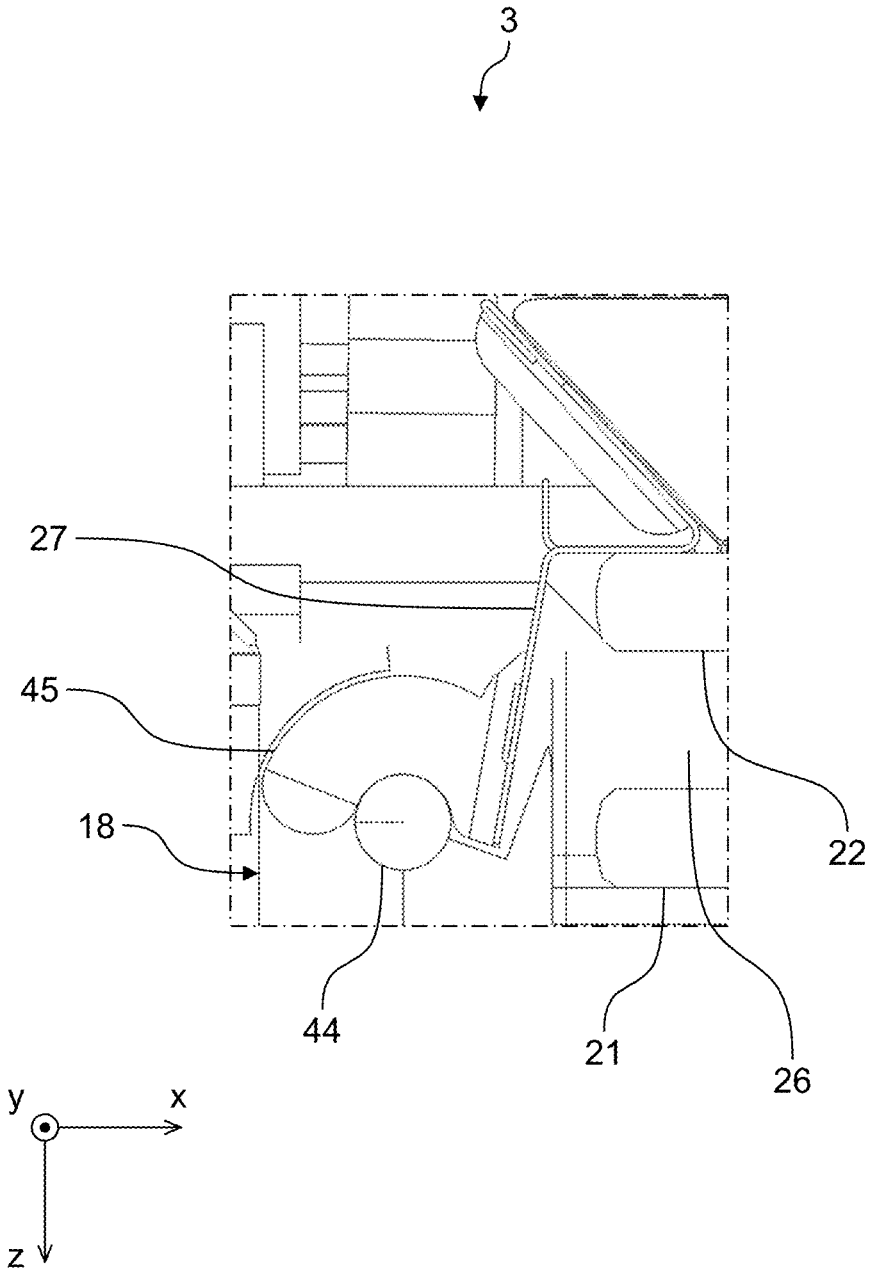
FIG. 11 shows a further schematic partial sectional view of the door according to FIG. 2.

FIG. 11 shows a further schematic partial sectional view of the door 3. FIG. 11 shows an alternative embodiment of the sealing facility 27. In this embodiment of the sealing facility 27 according to FIG. 11, a journal portion 44, which is encompassed at least in some portions by a shaft portion 45 of the sealing facility 27, is integrally formed on the first door support 18. The shaft portion 45 can be a plastic component.

Figure 12:
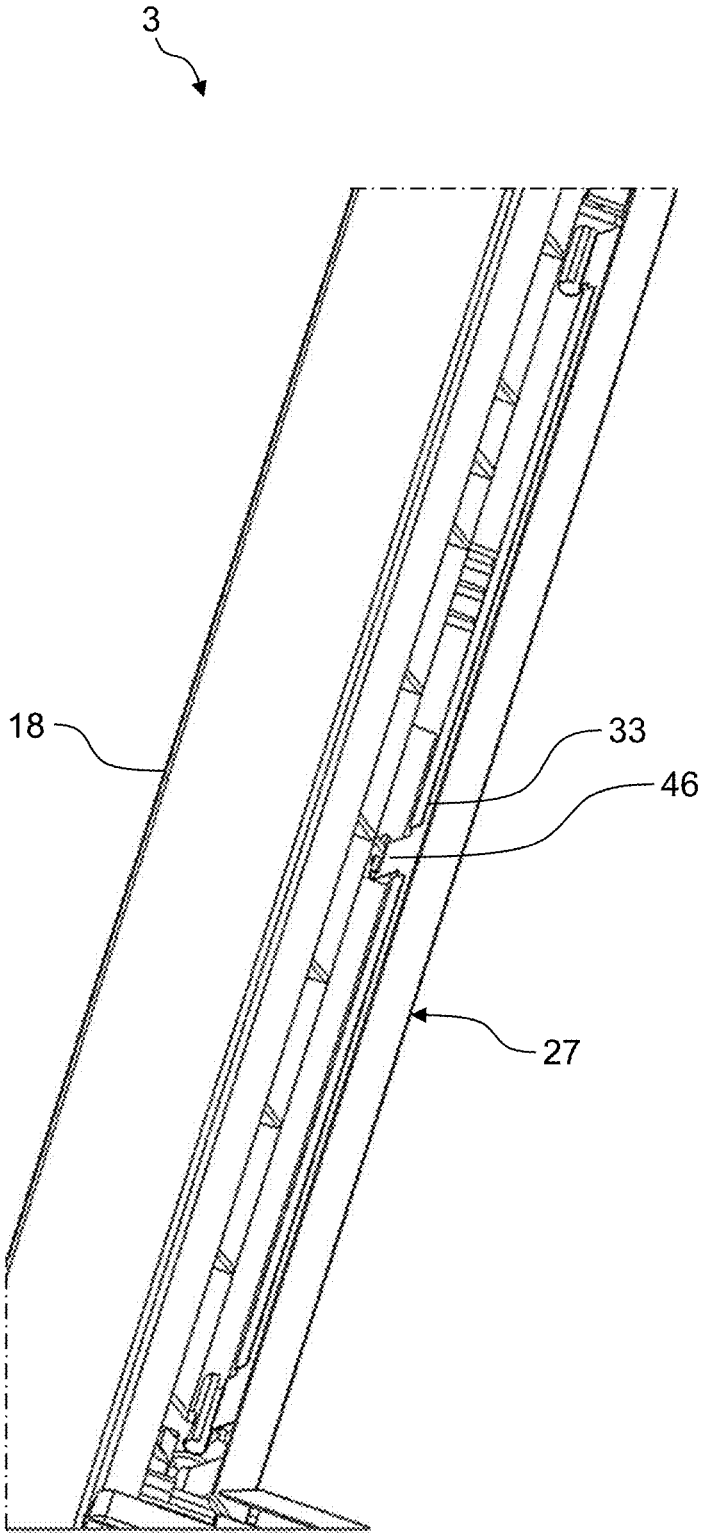
FIG. 12 shows a further schematic perspective partial view of the door according to FIG. 2.

FIG. 12 shows a further schematic perspective partial view of the door 3 with a development of the sealing facility 27. The sealing facility 27 according to FIG. 12 differs from the sealing facility 27 as explained above, in that a snap portion 46, which permits a locking of the sealing facility 27 to the first door support 18, is provided centrally on the base portion 33.

Figure 13:
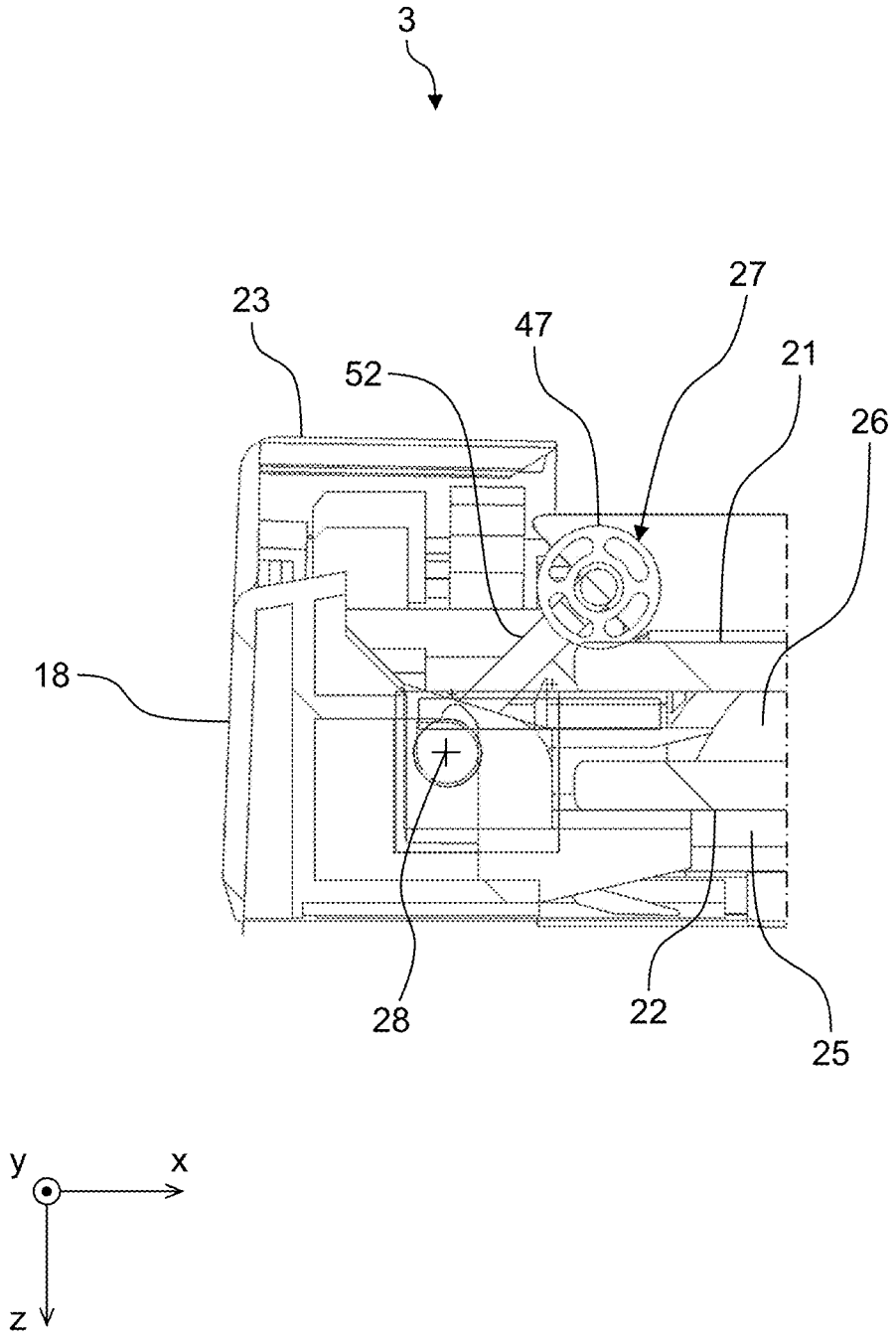
FIG. 13 shows a further schematic partial sectional view of the door according to FIG. 2.
Figure 14:
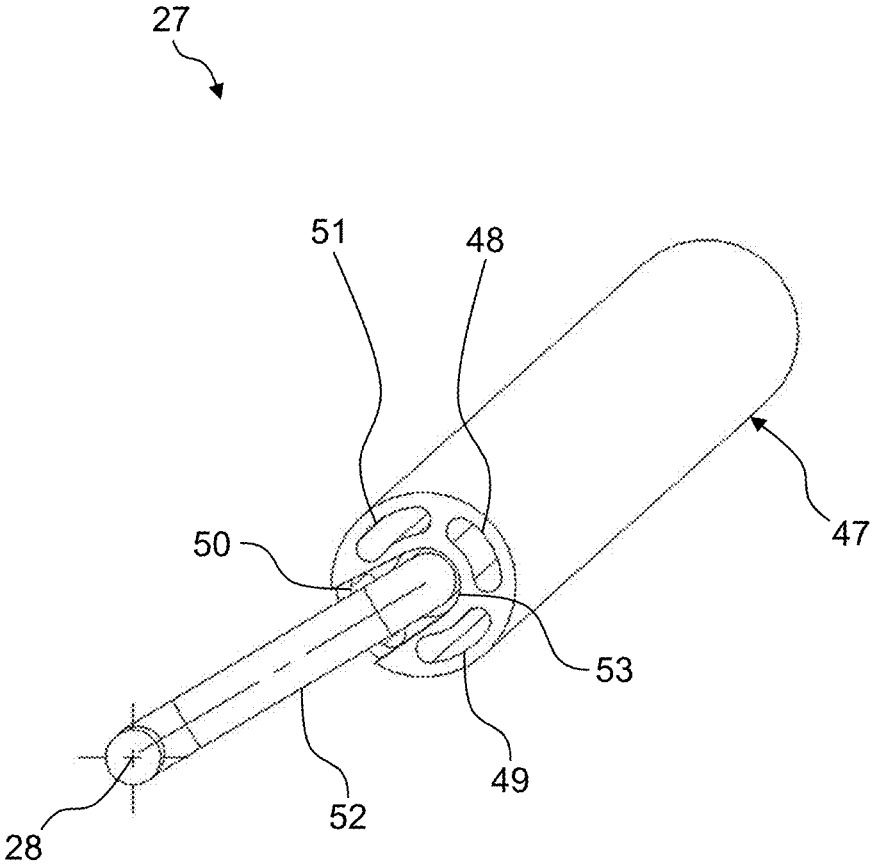
FIG. 14 shows a schematic perspective partial view of a further embodiment of a sealing facility for the door according to FIG. 2.

FIG. 13 shows a further schematic partial sectional view of the door 3 with a further embodiment of a sealing facility 27. FIG. 14 shows a schematic perspective view of the sealing facility 27. The sealing facility 27 according to FIG. 14 comprises a sealing portion 47 which is produced, for example, from silicone or glass fiber. The sealing portion 47 is cylindrical or roller-shaped and comprises a plurality of recesses 48 to 51 which are arranged so as to be distributed equally around a circumference of the sealing portion 47. The recesses 48 to 51 permit a compression of the sealing portion 47. The sealing portion 47 is threaded onto a wire 52 which is mounted on the first door support 18 so as to be pivotable about the axis of rotation 28. The wire 52 is guided through a central through-passage 53 of the sealing portion 47.

The advantages of the door 3 are that the entire door 3 can be dismantled and thus cleaned in a simple manner by the user. A clear reversibly blockable opening position in the form of the folded-out state Z2 is present during a cleaning process. A simple mounting of the sealing facilities 27 is possible. The sealing facility 27 is captively connected to the respective door support 18, 19. A simple sealing of the intermediate space 24 is possible. The stationary air cushion present in the intermediate space 24 leads to a thermal insulation and thus to a protection of the door supports 18, 19 which are produced from a plastic material and the locking facility 23.

Although the present invention has been described by way of exemplary embodiments, it can be modified in many different ways.

The invention claimed is:

1. A door for a household cooking appliance, said door comprising:

an outer pane;

an inner pane dismountable from the door;

an intermediate pane arranged between the outer pane and the inner pane and dismountable from the door; and a seal arranged at least in one portion between the inner pane and the intermediate pane, said seal configured, when the inner pane is dismounted, to pivot from a folded-in state in which the seal is in contact with the intermediate pane into a folded-out state in which the seal is not in contact with the intermediate pane, wherein the seal comprises a first sealing portion which bears against the intermediate pane when the inner pane is mounted, and a second sealing portion which bears against the inner pane when the inner pane is mounted, the first sealing portion and the second sealing portion are a singular structure, and the first sealing portion and the second sealing portion are arranged in a V-shaped manner in both the folded-in state and the folded-out state.

2. The door of claim 1, further comprising a door support fixedly or releasably connected to the outer pane.

3. The door of claim 2, wherein the door support is made from a plastic material.

4. The door of claim 2, wherein the door support includes a first door support and a second door support, and further comprising a further seal, said first and second door supports comprising the seal and the further seal, respectively.

5. The door of claim 2, wherein the seal is fixedly connected to the door support.

6. The door of claim 2, wherein the seal is mounted on a component of the door so as to be pivotable about an axis of rotation.

7. The door of claim 6, wherein the component is the door support.

8. The door of claim 6, wherein the seal comprises cylindrical bearing portions which are mounted in recesses of the door support, so as to be pivotable about the axis of rotation.

9. A door for a household cooking appliance, said door comprising:

an outer pane;

an inner pane dismountable from the door;

an intermediate pane arranged between the outer pane and the inner pane and dismountable from the door;

a seal arranged at least in one portion between the inner pane and the intermediate pane, said seal configured, when the inner pane is dismounted, to pivot from a folded-in state in which the seal is in contact with the intermediate pane into a folded-out state in which the seal is not in contact with the intermediate pane; and a door support fixedly or releasably connected to the outer pane, wherein, when pivoted from the folded-in state into the folded-out state, the seal is latched to the door support so that the seal automatically remains in the folded-out state.

10. The door of claim 1, wherein, when the inner pane is mounted, the seal is pressed between the inner pane and the intermediate pane.

11. The door of claim 1, wherein the seal is produced from a material selected from the group consisting of a metal sheet, glass fiber, and a silicone material.

12. The door of claim 1, wherein the intermediate pane is dismountable from the door only when the seal is pivoted into the folded-out state.

13. A household cooking appliance, comprising:

a cooking chamber; and a door attached to the cooking chamber and including an outer pane, an inner pane dismountable from the door, an intermediate pane arranged between the outer pane and the inner pane and dismountable from the door, and a seal arranged at least in one portion between the inner pane and the intermediate pane, said seal configured to pivot from a folded-in state in which the seal is in contact with the intermediate pane into a folded-out state in which the seal is not in contact with the intermediate pane, when the inner pane is dismounted, wherein the seal comprises a first sealing portion which bears against the intermediate pane when the inner pane is mounted, and a second sealing portion which bears against the inner pane when the inner pane is mounted, the first sealing portion and the second sealing portion are a singular structure, and the first sealing portion and the second sealing portion are arranged in a V-shaped manner in both the folded-in state and the folded-out state.

14. The household cooking appliance of claim 13, wherein the door includes a door support fixedly or releasably connected to the outer pane.

15. The household cooking appliance of claim 14, wherein the door support is made from a plastic material.

16. The household cooking appliance of claim 14, wherein the door support includes a first door support and a second door support, and further comprising a further seal, said first and second door supports comprising the seal and the further seal, respectively.

17. The household cooking appliance of claim 14, wherein the seal is fixedly connected to the door support.

* * * * *